United States Patent [19]

Whitefield

[11] 4,418,601

[45] Dec. 6, 1983

[54] STRING SNUB EFFECT SIMULATION FOR AN ELECTRONIC MUSICAL INSTRUMENT

[75] Inventor: John T. Whitefield, Harleysville, Pa.

[73] Assignee: Allen Organ Company, Macungie, Pa.

[21] Appl. No.: 368,495

[22] Filed: Apr. 15, 1982

[51] Int. Cl.[3] ..... G10H 1/057

[52] U.S. Cl. ..... 84/1.26; 84/1.13

[58] Field of Search ..... 84/1.13, 1.26

[56] References Cited

U.S. PATENT DOCUMENTS 4,352,312 10/1982 Whitefield et al. ..... 84/1.26 X

*Primary Examiner*—Stanley J. Witkowski

*Attorney, Agent, or Firm*—Sanford J. Piltch

[57] ABSTRACT

The string snub effect functions so as to introduce a different set of parameters for the harmonic content, envelope amplitude, shape and rate of decay and pitch of the resulting sound upon key release when a percussive string-type voice is selected in an electronic musical instrument. The apparatus for causing a snubbing of the resulting tone comprises a means for selecting a percussive string-type waveform and for generating a signal indicative of such selection, a means for detecting the release of a depressed key and the presence of the signal indicative of the selection of a percussive string-type waveform and for generating a signal indicative of such detection, a means for halting further interpolation of the selected waveform and switching to a preselected harmonic structure of said selected waveform, means for shifting the pitch of the generated tone of said selected waveform, and means for variably controlling the envelope amplitude, shape and rate of decay of the selected waveform. Each of the last three recited means being actuable in response to the signal indicative of the detection of the release of the depressed key and the signal indicative of the selection of a percussive string-type waveform for the duration of the transient period causing a snubbing of the produced tone.

10 Claims, 10 Drawing Figures

PITCH SHIFTER CONTROL

STRING SNUB EFFECT SIMULATION FOR AN ELECTRONIC MUSICAL INSTRUMENT

BACKGROUND OF THE INVENTION

Certain stringed instruments are susceptible to reproduction on or by electronic musical instruments such as electronic organs. The harpsichord is one such instrument. The harpsichord is a stringed keyboard instrument in which the depression of a key causes the associated string or strings to be plucked as one would manually pluck a banjo or guitar. During the time the key is held down the associated string is free to vibrate. Upon release of the key the plucking device or plectrum comes in contact with the string once again remaining in such contact until a damping means contacts the string. When the plectrum, being of a hard material, contacts the string causing a vibration, a sound is produced which in general is rich in harmonic content. With regard to the sound produced by a harpsichord that sound could be described as tinny. The string snubbing action caused by the plectrum on the release of the key quickly damps the string causing the resulting sound to decay away or diminish quickly. As an additional result of the plectrum coming in contact with the string, there is a positive shift in the pitch of the resultant sound due to the slight shortening of the vibrating portion of the string. Although the effect produced by the string snubbing action is short in duration, its contribution to the overall harpsichord sound is significant.

A different type of stringed keyboard instrument is the piano. The piano differs from the harpsichord in that the strings are struck with a hammer on depressing a key and damped with soft felt upon key release. The piano also produces a sound characteristic of that instrument as its strings are being forced to a non-vibrating condition. The result of the damping of the string is similar to that of the harpsichord in causing the resultant sound to decay or diminish relatively quickly.

It is therefore an object of this invention to provide a means for simulating a string snub effect by introducing a different set of parameters for the harmonic content, amplitude, pitch and rate of decay in the resulting sound upon key release.

It is another object of the present invention to be able to more accurately reproduce the sounds associated with struck or plucked strings as the strings are damped by either the plucking means and/or a damping means causing a shortening in the vibrating portion of the string, thus, a change in the resultant associated sound.

Other objects will appear hereinafter.

SUMMARY OF THE INVENTION

The above objectives may be accomplished using an electronic musical instrument such as an electronic organ or synthesizer in the following manner. The harmonic content of the resulting sound from a synthesized stringed keyboard instrument can be changed on the occurrence of the application of a damping device in at least two ways. The first, in the case where the tone color during the key down position was varying from a rather rich harmonic structure to something more mellow, would require switching the existing waveform memory at the time of key release from its present memory location to a location containing a richer harmonic structure. Although this technique limits the sound on key release to an existing harmonic structure, it is effective in many cases and does not require additional memory. The second would be to add another waveform memory in parallel to the existing waveform memory where the second memory is enabled on key release to achieve a change in the harmonic content. There are, of course, other configurations which one skilled in the art could use to achieve the same effect in addition to two above examples.

Controlling the amplitude of the resulting sound after key release is accomplished by switching either to a second envelope shaping means, or another memory location in the existing envelope shaping means. Stored in the second location is a special decay envelope whose amplitude characteristics give the desired result.

Controlling the pitch of the resulting sound after key release is accomplished by modifying the frequency numbers prior to their being used in the note generators. Finally, controlling the rate of decay of the resulting sound after key release is accomplished by switching a different count source into the attack/decay envelope generator at the time of and after key release until the tone has decayed to zero.

The present invention functions so as to introduce a different set of parameters for the harmonic content, envelope amplitude, shape and rate of decay and pitch of the resulting sound upon key release when a percussive string-type voice is selected. In an electronic musical instrument having a greater number of selectively actuable keys or switches than tone generators of the type wherein tones corresponding to the respective notes of the musical scale are produced by reading from memory stored sample points of harmonic structure of waveforms and envelopes characteristic of the selected waveforms, and by interpolating between said harmonic structures of the waveforms during the transient periods of said waveforms wherein an apparatus, consistent with the present invention for causing a snubbing of the tone produced in response to the depression and release of at least one key, comprises a means for selecting a percussive string-type waveform and for generating a signal indicative of such selection, a means for detecting the release of a depressed key and the presence of the signal indicative of the selection of a percussive string-type waveform and for generating a signal indicative of such detection, a means for halting further interpolation of the selected waveform and switching to a preselected harmonic structure of said selected waveform, means for shifting the pitch of the generated tone of said selected waveform, means for variably controlling the envelope amplitude, shape and rate of decay of the selected waveform, wherein said last three recited means being actuable in response to the signal indicative of the detection of the release of the depressed key and the signal indicative of the selection of a percussive string-type waveform for the duration of the transient period causing a snubbing of the produced tone.

The means for shifting the pitch of the generated tone of the selected waveform on the occurrence of the signal indicative of said detection causes an upward shift in the frequency resulting in the produced tone sounding sharper to the listener. The means for variably controlling the envelope amplitude, shape and rate of decay on the occurrence of the signal indicative of said detection causes a variation in envelope amplitude in accordance with any instantaneous changes in amplitude between the envelope associated with the preselected harmonic structure and the envelope associated with the harmonic structure which was being interpolated, a variation in envelope shape in accordance with any changes in said shape between the envelope associated with the preselected harmonic structure and the envelope associated with the harmonic structure which was being interpolated and an increase in the rate of decay of the transient waveform. The percussive string-type waveforms are waveforms selected from a group which comprise, by way of example, the stringed instruments commonly known as harpsichord, piano, harp, guitar, banjo and mandolin.

BRIEF DESCRIPTION OF THE DRAWINGS

For the purpose of illustrating the invention, there are shown in the drawings forms which are presently preferred; it being understood, however, that the invention is not limited to the precise arrangements and instrumentalities shown.

DETAILED DESCRIPTION OF THE PREFERRED EMBODIMENT OF THE INVENTION

The following detailed description is of the best presently contemplated modes of carrying out the present invention. This description is not intended in a limiting sense, but is made solely for the purpose of illustrating the general principles of the invention.

Figure 1A:
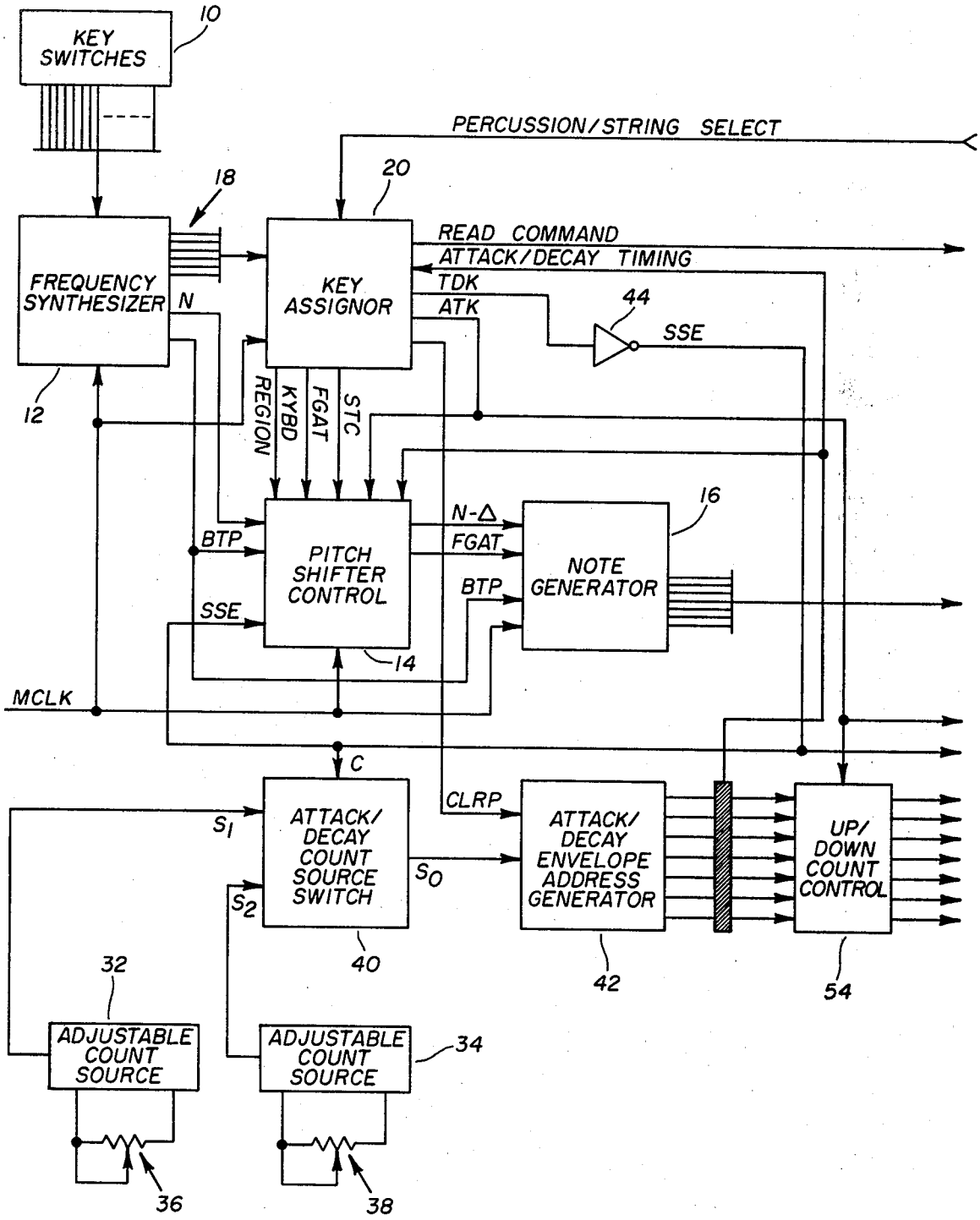
FIGS. 1A and 1B show, in block diagram form, the elements comprising the present invention.
Figure 1B:
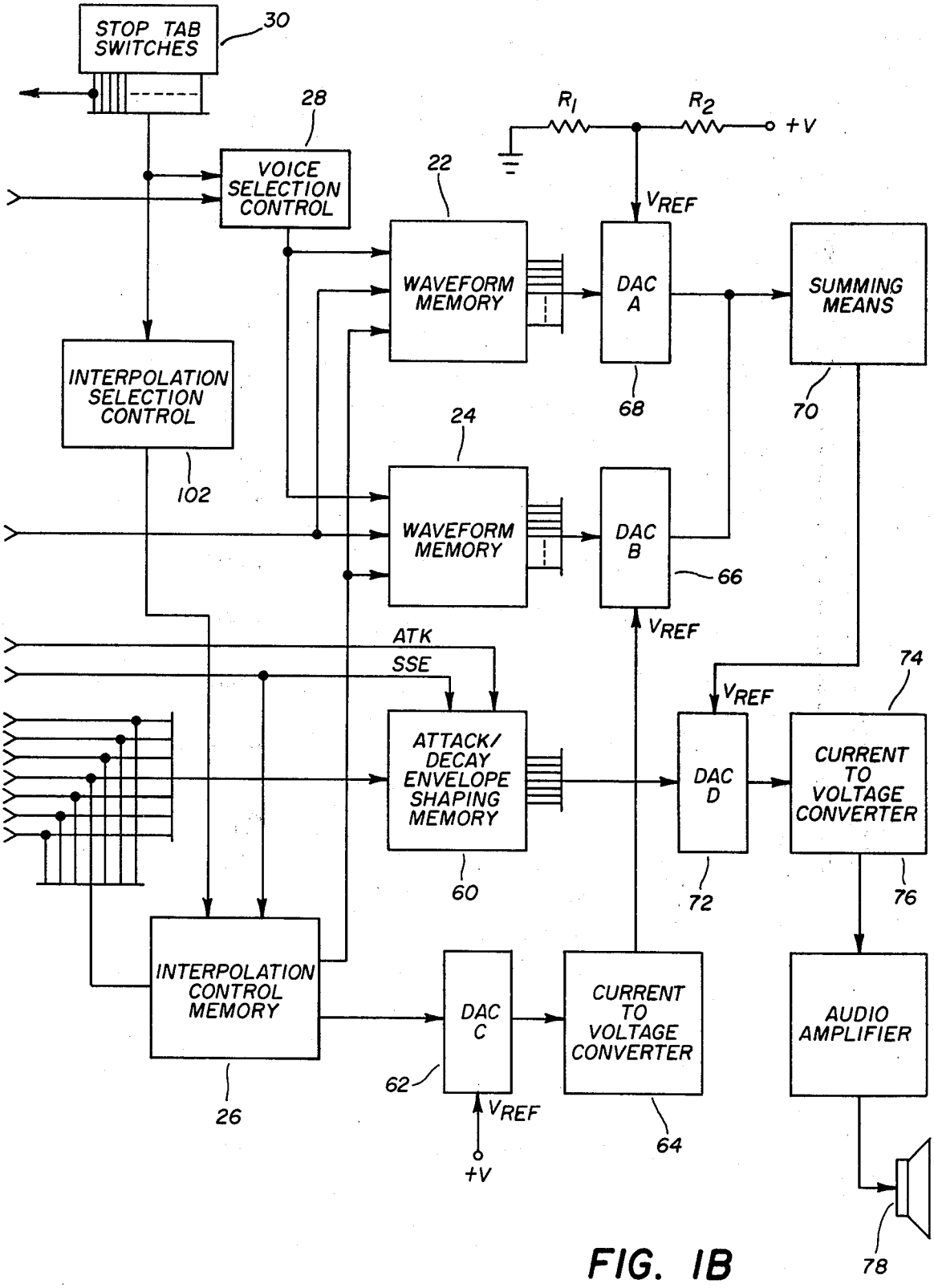

Referring now to the drawings in detail, wherein like numerals indicate like elements, there is shown in FIGS. 1A and 1B a schematic diagram, in block diagram form, of an electronic musical instrument embodying the present invention. An electronic musical instrument or digital electronic musical instrument in which the present invention may be applied and used is described in detail in U.S. Pat. Nos. 3,610,799 and 3,639,913 which are assigned to the assignee of the present invention. Reference may be had to these patents for detailed descriptions of components referred to herein other than the instant invention producing structural relationships in accordance with the invention. In addition, the attack-/decay envelope address generator of the present invention as it relates to frequency synthesization and key assignment logic is described in U.S. Pat. No. 3,610,805 which is also assigned to the assignee of the present invention. Reference may also be had to this patent for detailed descriptions of components referred to herein other than the instant invention producing similar structural relationships in accordance with the invention.

Referring to FIGS. 1A and 1B, there is shown a set of keys or key switches 10 making up the keyboard of the electronic musical instrument. The key switches 10 are used in the generic sense and will be referred to herein as keys, being the keys of various electronic musical instruments. The activity of the key, the actuation or depression and release thereof, is encoded in a time-division multiplexed format in accordance with the teachings of U.S. Pat. No. 3,610,799. The time-division multiplexed signal proceeds to frequency synthesizer 12 which generates a frequency number N corresponding to the actuated key. The frequency number N is generated in a serial format and proceeds to pitch shifter control 14. The pitch shifter control 14, when enabled, varies the pitch of the resulting tone increasing or decreasing the frequency number N by a value of $\Delta$. When not enabled the pitch shifter control 14 permits the frequency number N to pass through unchanged. A complete description of the operation and function of the pitch shifter control 14 appears hereinafter. The frequency number N (or the frequency number $N-\Delta$) then proceeds to note generator 16. Note generator 16 denotes a number of note generators in accordance with the teachings of the previously mentioned patent. However, it is understood that the number of note generators could be limited to one if only a single note is required to sound at a time.

The frequency synthesizer 12 also generates a timing pulse, BTP, which is used for internal timing functions in the pitch shifter control 14 and the note generator 16. The internal timing function in the note generators refers to the one $\mu$-second time slots allotted to each of twelve multiplexed channels, each channel corresponding to a note generator. Frequency synthesizer 12 also supplies keyboard division, octave and note information along lines 18 to key assigner 20. Key assigner 20 generates a claiming pulse, FGAT, for claiming any one of the note generators in note generator 16 in accordance with the internal timing functions. Frequency synthesizer 12, pitch shifter control 14, note generator 16 and key assigner 20 are each controlled by a master system clock, MCLK. For a more detailed explanation of the interrelationship of these devices reference should be made to the above-listed patents which are incorporated herein by reference.

The note generator 16 generates an address which is transmitted to each of the waveform memories 22, 24 to provide access to the memory location to be read out within the multiplexing scheme of the keyboard musical instrument. The waveform memories 22, 24 are also addressed by interpolation control memory 26 and voice selection control 28 which addressing will be described more fully hereinafter.

Concurrently, with the generating of a memory address from note generator 16, the key assigner 20 generates a read command to the voice selection control 28. The voice selection control 28 senses which of the stop tab switches 30 are selected and generates an address to both waveform memories 22, 24 which designates the memory location of a specific voice or voices in accordance with the setting of the stop tab switches 30. The address from the voice selection control 28 is generated simultaneously with the address from the note generator 16. In this manner, which is in accordance with the teachings of the previously referenced patents, the information from the desired memory locations is read out of each of the waveform memories 22 and 24, at the frequencies corresponding to the depressed keys. It should be noted that the combined address of the waveform memories is made up of signals from the note generator 16, interpolation control memory 26 and voice selector control 28.

The key assigner 20 also generates additional signals. These are a clear pulse signal, CLRP; an attack transient detection signal, ATK; a keyboard region signal; a signal denoting the claim status of a key, STC, (a key is claimed by a note generator at some time after its depression or actuation); and, a signal denoting the release of a key, TDK. These signals will be described more fully in connection with the operation and control of the present invention hereinafter.

The present invention of effecting a string snub simulation as it relates to the reproduced tone is one in which the harmonic content of the reproduced tone is very rich at the onset of the tone and gradually becomes more flute like as time passes. The resulting tone, in this case, is a product of harmonic interpolation similar in method and apparatus to that descirbed in U.S. Pat. No. 4,352,312, invented by John Thomas Whitefield and Robert P. Woron and patent application Ser. No. 06/432,583, invented by John Thomas Whitefield. The patent and application are assigned to the assignee of the present invention. Reference may be had to both the patent and the patent application for detailed descriptions of components referred to herein other than the instant invention producing structural relationships in accordance with the invention. For the ease of understanding the present invention a brief description of the harmonic interpolation function of the present invention follows.

The adjustable count sources 32, 34 each comprise a count source which may be a 555 timer, a voltage controlled oscillator, or an equivalent thereto such as can be constructed by anyone skilled in the art. A variable electrical resistive device 36, 38, e.g., potentiometer, resistor, regulates the repetition rate of the count sources 32, 34. It is preferred that a 555 timer be used whose repetition rate is regulated by the variable resistors 36, 38 set to different values to cause a higher repetition rate in count source 34. These variable resistors 36, 38 may also take the form of variable potentiometers.

Figure 6:
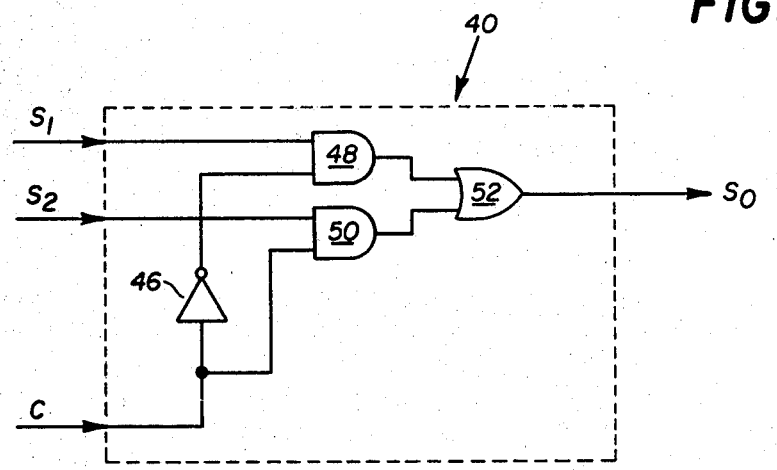
FIG. 6 is a logic diagram of the attack/decay count source switch of the present invention.

The attack/decay count source switch 40 controls the source of the repetition rate to the attack/decay envelope address generator. 42. Initially, adjustable count source 32, through input S1 of switch 40, remains selected when percussive string-type voices are selected. A percussion/string select signal emanates from the stop tab switches 30 and is detected by the key assigner 20 when any one of the stop tab switches 30 corresponding to a percussive string-type voice is depressed. The key assigner 20 generates in response to the occurrence of the percussion/string select signal and the release of a key a signal denoting such release, TDK. The TDK signal, which is a logical "1" during key depression, changes to a logical "0" on key release. It is then inverted by inverter 44 to be used in the present invention. Appearing at the output of inverter 44 is the string snub effect signal, SSE, which is active in its logical "1" state. This SSE signal is applied to input C of the attack/decay count source switch 40 for controlling the switching function. Referring to FIG. 6, the switch 40 is connected through its input S1 to adjustable count source 32 and is connected through its input S2 to adjustable count source 34. The switch 40 is also connected through its input C to the SSE signal and generates an output at S0. The SSE signal is a logical "0" when a key is depressed and the percussion/string select signal appears at the key assigner 20. The SSE signal changes to a logical "1" when a key is released and the percussion string selected signal appears at key assigner 20. The SSE signal changing to a logical "1" will cause the switch 40 to select the adjustable count source 34. This is accomplished in the following manner. The SSE signal through input C of switch 40 goes to the input of inverter 46. If the SSE signal is a logical "0" the AND gate 48 is enabled allowing the signal from the adjustable count source 32 through input S1 of the switch 40 to pass through to OR gate 52 and the output S0. If the SSE signal is a logical "1" AND gate 48 is disabled by inverter 46 and AND gate 50 is enabled permitting the signal from the adjustable count source 34 to be inputted at S2 and flow through OR gate 52 to the output S0. The output of switch 40, S0, is connected to the attack/decay envelope address generator 42. Thus, the counting rate for the attack/decay envelope address generator 42 is controlled by the switch 40.

The attack/decay envelope address generator 42 provides for the reading out of an address based on the count of a counter included in the envelope address generator 42. The count rate is determined by either one of the adjustable count sources, 32, 34 attached through count source switch 40. The envelope address generator 42 functions in a multiplexed manner in accordance with the aforementioned patents wherein it has as many channels as there are note generators in note generator 16. The clear pulse, CLRP, generated by key assigner 20, functions to reset the counter of the envelope address generator 42 to a 0 on the channel corresponding to its occurrence in the multiplexed timing sheme. For a more detailed explanation of the interrelationship of the envelope address generator to the basic electronic musical instrument of the present invention reference should be made to U.S. Pat. No. 3,610,805 which is incorporated herein by reference.

Figure 5:
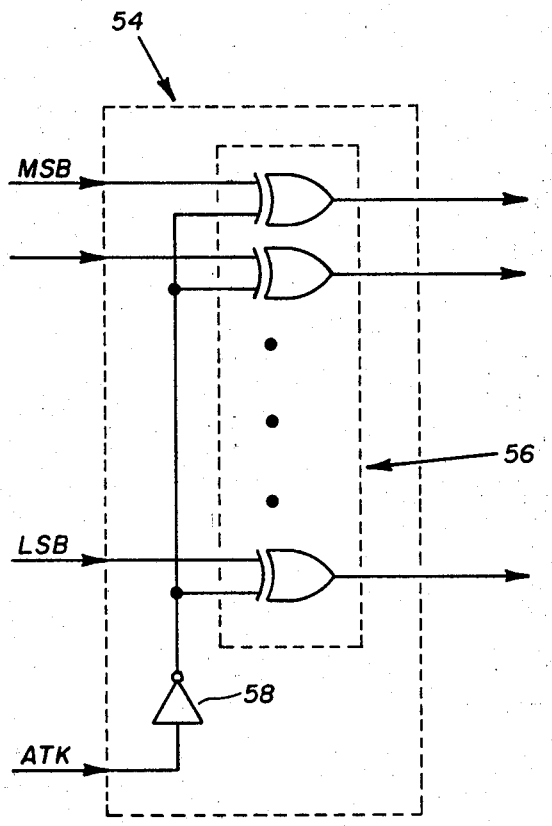
FIG. 5 is a logic diagram of the up/down count controller of the present invention.

The address from the attack/decay envelope address generator 42 contains seven bits which are transmitted to an up/down count control 54. The transient attack detection signal, ATK, generated by key assigner 20 is sensed by the up/down count control 54 so that when the ATK signal is present, the count control 54 permits an increasing count and when the ATK signal is absent the count control permits a decreasing count. Referring to FIG. 5, the up/down count control 54 comprises a set of exclusive OR gates 56 equivalent in number to the number of address lines from the attack/decay envelope address generator 42. One input of each of these exclusive OR gates 56 is connected to each of the address lines of the envelope address generator 42. The other input of each of the exclusive OR gates 36 is connected to the ATK signal line through an inverter 58. The presence or absence of the ATK signal, whether it is a logical "1" or a logical "0", will control the output of the count controller 54 as described above. It should be noted that the output of attack/decay envelope address generator 42 is the attack/decay timing signal referred to in U.S. Pat. No. 3,610,805 and, as such, is sampled at the output of envelope address generator 42 and sensed by key assigner 20 in accordance with the teaching of said patent. The output of the envelope address generator 42 is also used as in input to the pitch shifter control 14 which use will be more fully described hereinafter. The output of up/down count control 54 is used as an address for the interpolation control memory 26 and the attack/decay envelope shaping memory 60 and will be discussed more fully hereinafter.

Continuing with the description of the interpolation scheme of the present invention, the outputs of the up/down count control 54 will be used to simultaneously address waveform memories 22, 24 and digital to analog coverter 62, DAC C, after being processed by interpolation control memory 26. The specific breakdown of the outputs of interpolation control memory 26 as they affect waveform memories 22, 24 and DAC C will be discussed in detail later in this application. DAC C is a multiplying digital to analog converter similar to Analog Devices AD7523. The outputs of such devices have currents which are proportional to the product of its digital input code and its analog reference voltage. The output of DAC C is fed into current to voltage converter 64. The configuration of the current to voltage converter 64 is a standard current to unipolar voltage scheme recommended by the DAC manufacturer. The current to voltage converter 64 creates an output voltage which is used as the reference voltage applied to digital to analog converter 66, DAC B. The reference voltage applied to DAC C has a positive value which allows the output of DAC C to vary between 0 and full scale in a step-like manner in accordance with the value of the output of the interpolation control memory 26.

Waveform memory 22 contain a number of discrete harmonic structures found in adjacent zones for a preselected number of voices which are accessed and read out of the memory according to composite addresses, portions of which are received from the voice selection control 28, note generator 16, and interpolation control memory 26 respectively. Waveform memory 24 is accessed in the same manner as waveform memory 22 and contains in its memory locations difference values which are the algebraic differences between the discrete harmonic structures found in adjacent zones of waveform memory 22. The waveform memories 22, 24 are read only memories, ROMs, structured in sections according to voice. Each of the voice sections is divided into a number of transient harmonic zones wherein each zone contains a number of waveform sample points having a fixed number of bits. Reference may be had to the aforementioned patent and patent application for a more detailed description of the internal structure of the waveform memories 22, 24. However, it should be understood that the specific structure described therein should not be considered a limiting one as any equivalent scheme which can be derived by one skilled in the art would be susceptible to use within the present invention.

The outputs from the waveform memories 22, 24 are connected to the inputs of digital to analog converters 68 and 66, DAC A and DAC B, respectively. DAC A is a multiplying digital to analog converter similar to Analog Devices AD7523 whose output currents are proportional to the product of its digital input and its analog reference voltage input. The reference voltage for DAC A is determined by the value of resistors R1, R2 and a supply voltage, +V. The supply voltage to the reference voltage input of the digital to analog converting devices has been chosen in accordance with the manufacturer's recommendation of a range between +10 V and −10 V. It is preferred that the supply voltage +V be in the range of +5 V to +10 V. DAC B is also a multiplying digital to analog converter similar to the AD7523 where the reference voltage input varies with time in accordance with the output of DAC C and current to voltage converter 64.

The outputs of DAC A and DAC B are supplied to summing means 70 where the output currents of both DAC A and DAC B are added and coverted to a voltage. Reference should be made to the aforementioned patent and patent application for a detailed explanation of the interrelationship of those components making up summing means 70 which explanation is incorporated herein by reference.

The output of summing means 70 is used as the reference voltage for digital to analog converter 72, DAC D, another multiplying digital to analog converter similar to the AD7523. The digital input to DAC D from the attack/decay envelope shaping memory 60 is in the form of a seven bit address. The envelope shaping memory 60 is a read-only memory, ROM, in which an attack or decay envelope shape is stored as the sampled waveform. The envelope shaping memory 60 is a $7\times r$ bit device, r being the number of envelope shapes stored in memory, where the attack or the decay section of memory is addressed depending upon the presence or absence of the ATK and SSE signals. The memory location address for the envelope shaping memory 60 is the entire output of the up/down count control 54. DAC D accepts seven input lines from the envelope shaping memory 60 and is connected as in the case of DAC C to a current to voltage converter 74. The circuit configuration of the current to voltage converter 74 is also a standard current to unipolar voltage scheme recommended by the digital to analog converting device manufacturer which is familiar to those skilled in the art.

DAC D performs the function of combining the interpolated transient harmonic structures with the appropriate transient period envelope. Thus, the output of DAC D is the product of the transient harmonic structure interpolation sequence and the transient or attack period envelope. The output from current to voltage converter 74 is fed into audio amplifier 76. The output of audio amplifier 76 goes to a standard sound transducing device such as a speaker 78 which creates the audible sound of the selected voices corresponding to the actuated keys of the electronic musical instrument.

Figure 4:
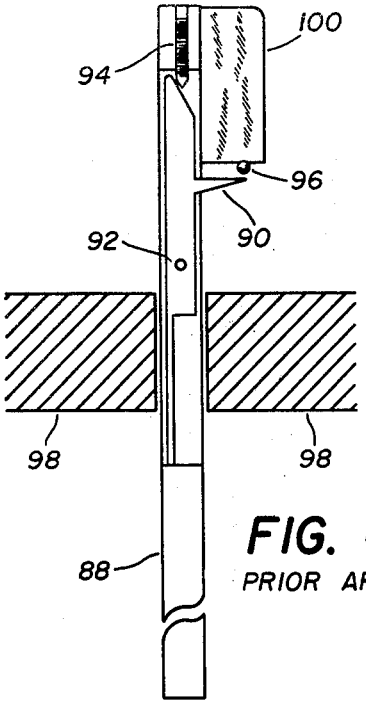
FIG. 4 PRIOR ART
FIG. 4 is an enlarged sectional drawing of the mechanical linkage of FIG. 3 taken along line 4—4.
Figure 3:
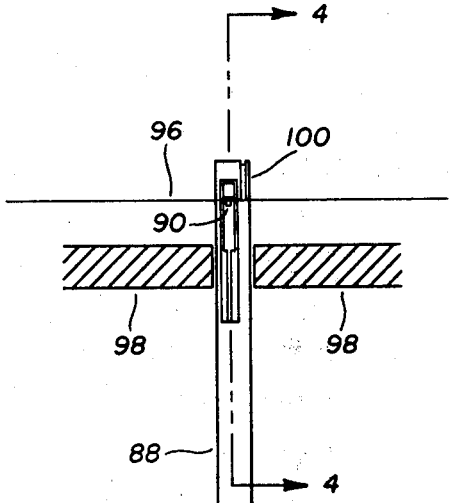
FIG. 3 PRIOR ART
FIG. 3 is a drawing of one example of existing mechanical linkage for plucking a string in a harpsichord.

Referring now to FIG. 3 and 4 in which there is depicted the mechanical devices for plucking a harpsichord string, a description of the interrelationship of the mechanical components follows. The harpsichord key 80 is supported in the harpsichord key bed on a fulcrum 82. The key 80 is guided in its vertical motion by guide pin 84. The key arm 86, at its distal end from the playing surface, contacts a plunger-like support arm 88 which is permitted to move only in a reciprocating manner in the vertical direction. The support arm 88 carries on it a plectrum 90 which is used for plucking the string 96. The plectrum 90 can be made of any sufficiently hard material so as to not deform as it plucks the string 96. However, the plectrum 90 should not be made from material which would abrade or cut the string 96 as it is plucked. The plectrum 90 is secured to the support arm 88 by pin 92 and is permitted to rotate about said pin. Motion of the plectrum toward the string 96 is checked by a set screw mechanism 94 at the top of the plectrum 90 which prevents the plectrum from moving too close to the string and by a groove in the support arm 88 at the bottom (not shown) which prevents the plectrum 90 from moving too far away from the string 96. These mechanisms allow only the point of the plectrum 90 to come into contact with the string 96.

In its reciprocal vertical motion the support arm 88 is guided by a support arm guide 98 which may be made from wood or other suitable material. The support arm guide 98 allows the support arm 88 to travel only in the its reciprocating vertical direction.

When depressed the key 80 causes the support arm 88 to move in an upward vertical motion. The upward vertical motion of the support arm 88 through the guide 98 causes the plectrum 90 to come in contact with the string 96 and, while moving slightly away from the string and upward with the motion of the support arm 88, plucks the string causing the string to vibrate. As the key is released the plectrum 90 follows the downward vertical motion of the support arm 88 and comes in contact with the string 96 again but this time rotates slightly away from it causing a damping effect on the vibrating string and on the sound produced. The damping effect is caused by the slightly shortening of the length of string 96 which is permitted to vibrate. The damping effect is completed as the felt damper 100 comes into contact with the string 96 as the support arm 88 and key 80 return to their normal positions due to the force of gravity. Thus the interrelationships of the above-described mechanical components cause a slight shortening of the vibrating portion of the string on key release which in turn causes a change in the harmonic structure, amplitude, shape and rate of decay of the associated envelope and pitch of the resulting sound emanating from the plucked string.

PREFERRED EMBODIMENT OF THE PRESENT INVENTION

Figure 8:
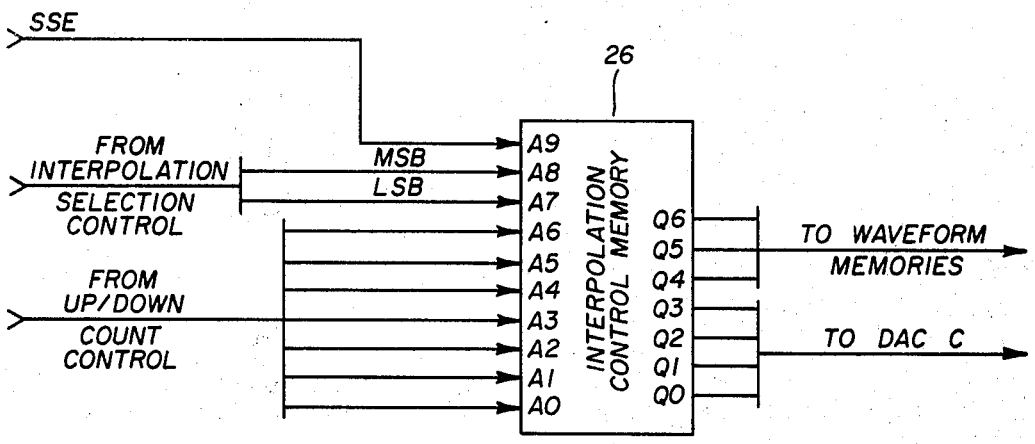
FIG. 8 shows, in block diagram form, the data memory of the present invention.
Figure 9:
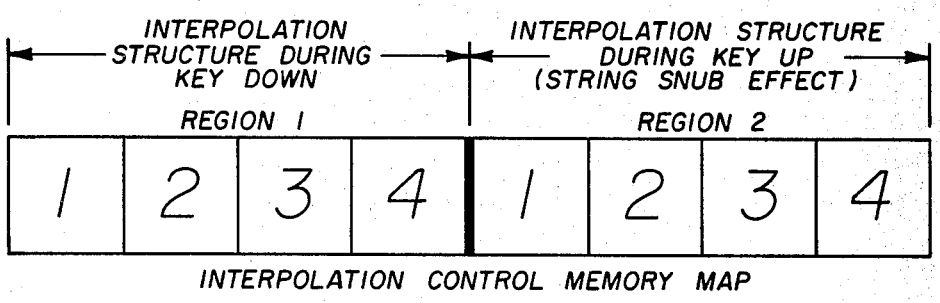
FIG. 9 shows a graphical representation of the memory map of the data memory of the present invention.

The string snub effect of the present invention is achieved by causing the interpolation of the waveform harmonic structures to cease and by changing the envelope amplitude, shape and rate of decay of the resulting tone and, further, changing its associated pitch. These functions are controlled by the interpolation selection control 102 and the interpolation control memory 26. The interpolations selection control 102 detects the presence of percussive string-type voices which have been selected on the stop tab switches 30. In turn, the interpolation selection control 102 generates a signal indicative of such detection to the interpolation control memory 26. This signal may have different configurations but is preferred to be a 2 bit signal which serves as a portion of the memory address to be described more fully hereinafter. Referring now to FIG. 8, it is preferred that the interpolation control memory 26 have 10 address lines A0–A9. The interpolation control memory 26 receives a count indicative of an address from the up/down count control 54 on its address lines A0–A6. On address lines A7, A8 the interpolation control memory 26 receives an address indicative of which of the voices of the percussive string-type voices selectable from the stop tab switches 30 have been detected by the interpolation selection control 102. On address line A9 interpolation control memory 26 receives the SSE signal which causes the memory to select the region from which it will read out addresses to waveform memories 22, 24 and DAC C. The major change in memory location or region caused by an active SSE signal is delineated by the interpolation control memory map in FIG. 9. In a key down situation where the percussion/string select line is active the SSE signal will be a logical "0". This causes the interpolation control memory 26 to read out from one of four zones of region 1 the harmonic structure of the selected voice according to the address lines received from the up/down count control 54 and the interpolation selection control 102. Each of the zones of the memory 26 correspond to one of four voices detected by the interpolation selection control 102. The control 102 also detects the presence of the percussion/string select signal. This information is processed by a priority encoder of a type similar to the Motorola MC 14532 which gives a 2 bit binary output code. This code is used as a portion of the address to the memory 26. Of course, this method and others in which the stop tab information could be interpreted for use in the present invention are familiar to those skilled in the art. In the key up situation the SSE signal changes to a logical "1" causing a change in the address to the interpolation control memory 26. This in turn causes the interpolation control memory 26 to read out the string snub harmonic structures of region 2 in accordance with the values on the address lines from the up/down count control 54 and the interpolation selection control 102.

The interpolation control memory 26 has seven output lines Q0–Q6. The values stored in memory are read out over the output lines Q0–Q6 in the following manner. The three most significant address lines Q4–Q6 are read out to waveform memories 22, 24. The four least significant output lines Q0–Q3 are read out to DAC C. These values on the output lines Q0–Q6 will be used by the connecting devices in accordance with the previous description.

On the occurrence of the SSE signal becoming a logical "1", which is indicative of a key up situation, the harmonic interpolation will be halted. The harmonic structure which will be heard will depend upon the coded signal from the interpolation selection control 102 and the data loaded in memory 26. This harmonic structure will remain for the audible duration of the tone.

Figure 7:
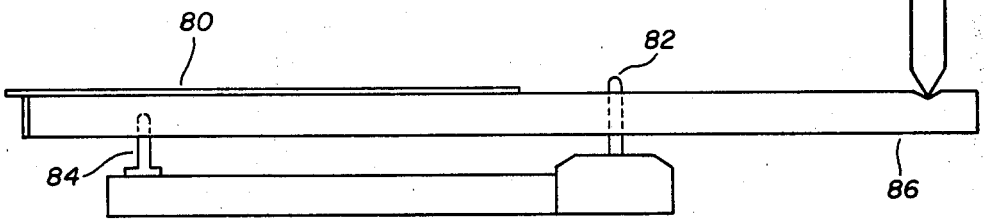
FIG. 7 shows a graphical representation of the envelope amplitude versus time of a sample waveform affected by the present invention.
Figure 7:
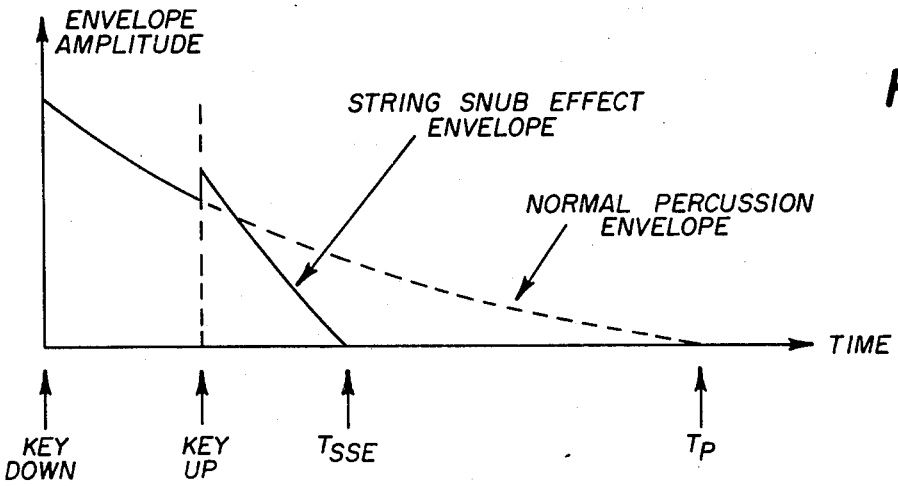

The changes in envelope amplitude, shape and rate of decay are described more easily with reference to FIG. 7. On key down the envelope address generator 42 receives a count from adjustable count source 32 through count source switch 40 which count is supplied through the up/down count control 54 to the envelope shaping memory 60. The resulting envelope, as shown in FIG. 7 as the Normal Percussion Envelope, will correspond to the seven address input lines to the envelope shaping memory 60 and the additional address lines associated with the ATK and SSE signals. On key down the ATK signal will be a logical "1" and the SSE signal will be a logical "0". It should be noted that the SSE signal is the most significant address input line to the envelope shaping memory 60 and the ATK signal address line is the next most significant address input line. If the string snub effect was not applied to the waveform of the resulting tone the Normal Percussion Envelope would result as shown by the dotted line in FIG. 7 decaying in the normal time period indicated by $T_p$. However, with the string snub effect enable, on key up an instantaneous change in the envelope amplitude can be seen. This change is the difference between the envelope amplitude of the harmonic structure being interpolated at the instant before the release of the key is detected, when the SSE signal is a logical "0", and the envelope amplitude of the substituted harmonic structure which is being read from the waveform memories 22, 24 when the SSE signal has changed to its logical "1" state. The envelope wave shape for the string snub effect is shown in FIG. 7 as the String Snub Effect Envelope which decays to a point $T_{SSE}$. The change in envelope wave shape is caused by the change in address to the envelope shaping memory 60 by the SSE signal changing state causing a different memory location to be accessed.

The shorter decay period, $T_{SSE}$, is caused by the count source switch 40 detecting a change in the SSE signal causing the switch 40 to select the count from adjustable count source 34 through its S2 input and passing this count through to the envelope address generator 42. The change in count rates causes an increase in the rate of decay as detected by the envelope shaping memory 60 causing DAC D to scale down its output in a more rapid fashion. This in turn causes the audible sound to decay to zero more quickly than normal.

Figure 2:
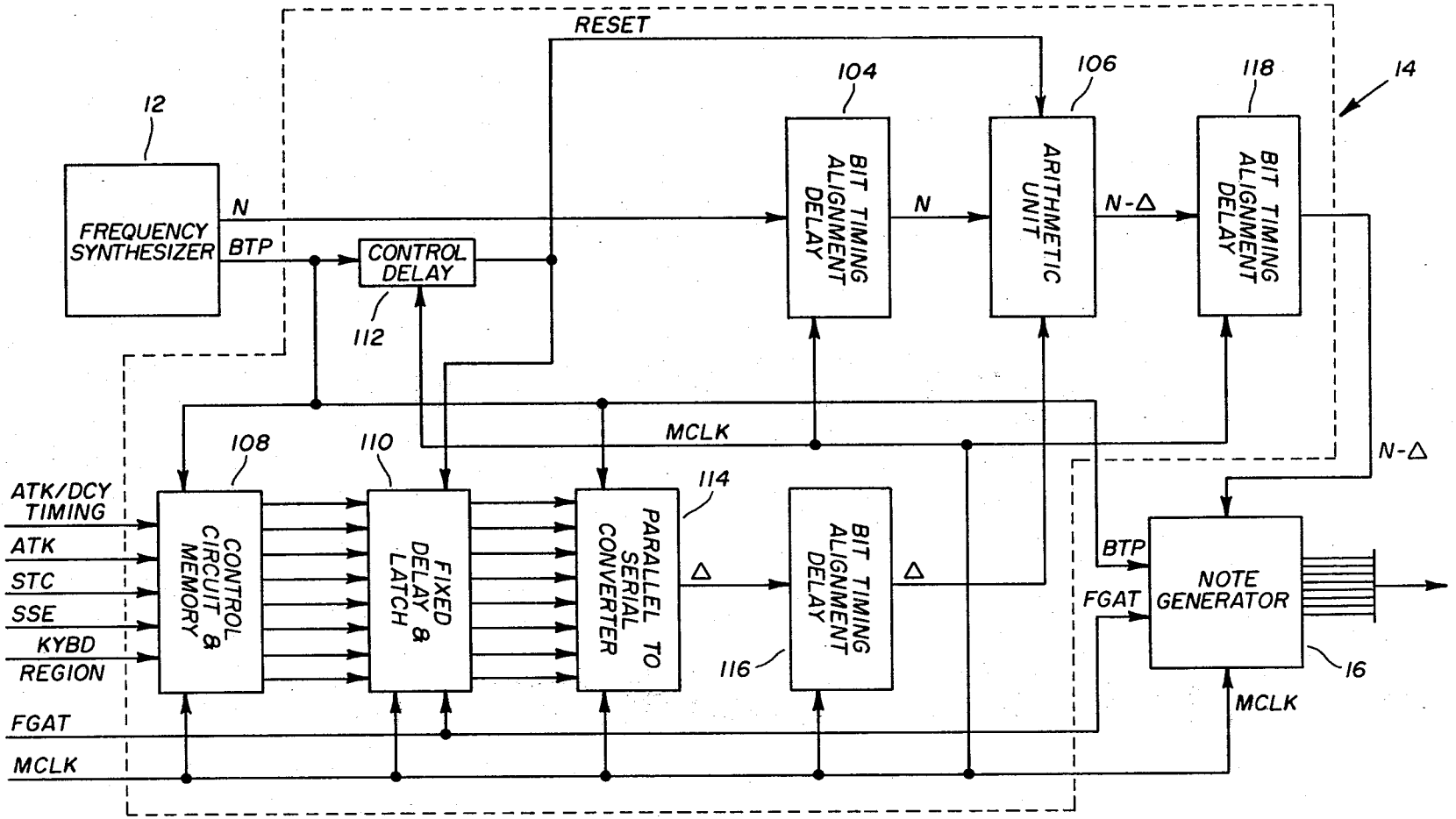
FIG. 2 shows, in block diagram form, the pitch shifter control of the present invention.

The remaining function of the present invention is the shifting of the pitch of the resulting tone on the occurrence of the detection of the release of the key. This is accomplished by pitch shifter control 14 operating on the frequency number N by introducing a factor Δ and applying the changed frequency number to the note generator 16. The pitch shifter control 14 can be seen in greater detail by referring to FIG. 2. It should be noted that the pitch may be shifted by using either a parallel or a serial shifter control. The following description is of a serial type pitch shifter control.

The pitch shifter control 14 functions by arithmetically summing the frequency number N from frequency synthesizer 12 with a Δ from a read only memory located within the pitch shifter control 14 and outputting the new frequency number N-Δ to generator 16. This is accomplished in the following manner. The frequency synthesizer 12 provides a frequency number N in accordance with the teachings of U.S. Pat. No. 3,610,799. This frequency number N is applied to the pitch shifter control 14 and delayed in time sequence by bit timing alignment delay 104 so as to arrive at the arithmetic unit 106 at the same instant as the corresponding pitch shift number Δ. A control circuit and memory device 108 is comprised of logic gates for controlling the addressing and reading out from the read only memory, ROM, the pitch shift number Δ. The attack/decay timing, ATK and keyboard region signals comprise the primary address lines for the read only memory portion of device 108. The pitch shift number Δ is loaded into the ROM of device 108 in accordance with the desired effect to the resulting tone. The STC signal, which occurs in the multiplexed format of the apparatus of the foregoing patents at the time of assignment to or claim by a selected note generator of a frequency number N corresponding to a depressed key, and the SSE signal comprise the enable signal for device 108 and permit the reading out of the pitch shift number Δ. If the SSE signal is not present the pitch shift number Δ corresponds to zero so as not to effect the frequency number N.

The pitch shift number Δ is read out of the memory device 108 in accordance with the bit timing pulses, BTP, from the frequency synthesizer 12 when properly enabled. Pitch shift number Δ proceeds through the fixed delay and latch 110, which causes a momentary delay and latches the pitch shift number Δ on the occurrence of the FGAT signal corresponding to the correct multiplexed channel. The latch is reset in accordance with the reset signal from the control delay 112. The pitch shift number Δ is then converted from a parallel number to a serial number in the parallel to serial converter 114 and delayed again by the bit timing alignment delay 116. The bit timing alignment delays 104, 116 are so arranged as to permit corresponding frequency numbers N and pitch shift numbers Δ to arrive at the arithmetic unit 106 at the same instant so as to affect a change in the correct frequency number. On the completion of the arithmetic summing of the frequency number N and the pitch shift number Δ the arithmetic unit 106 is reset in accordance with the signal from control delay 112. The new frequency number N-Δ leaves the arithmetic unit 106 and is delayed again in bit timing alignment delay 118. The purpose of the bit timing alignment delay elements 104, 116 and 118 are to align the bits comprising the frequency number N and the bits comprising the pitch shift number Δ in coincidence so that corresponding numbers will be summed in arithmetic unit 106. Further, delay element 118 realigns the resulting frequency number N-Δ into the normal timing sequence so that it can be properly interpreted in the note generator 16. It should be noted that all elements of the pitch shifter control 14 are clocked in accordance with the master clock system, MCLK, of the electronic musical instrument. For a more detailed explanation of the serial pitch shifter control described above or an equivalent parallel pitch shifter control reference should be had to patent application Ser. No. 06/469,472 (which is a continuation of patent application Ser. No. 06/289,940, now abandoned) invented by Thomas M. Schenck and Stephen A. Wise and assigned to the assignee of the present invention. Reference may also be had to this patent application for detailed descriptions of the components referred to herein other than the instant invention which produced similar structural relationships in accordance with the overall structure of the electronic musical instrument which are incorporated reference.

Thus, on the occurrence of the SSE signal to the pitch shifter control 14 an audibly noticeable shift in pitch in the resulting tone occurs in accordance with the pitch shift number Δ which was placed in the memory device 108 of the pitch shifter control.

In summary, the depression or actuation of a key in an electronic musical instrument causes an abrupt rise in signal level producing an harmonically rich sound. As time passes the harmonic content of this sound becomes less rich as the amplitude drops off. At the time key release is detected when a percussive string-type voice is selected the present invention causes the harmonic structure of the waveform to change to a different by appropriate harmonic structure as well as disabling any further interpolation of the harmonic structure of the tone. The envelope amplitude instantaneously changes to a greater or lesser value depending upon the envelope associated with the selected voice on the occurrence of the change of state of the SSE signal. In addition, the envelope decay curve shape changes based on the information in the attack/decay envelope shaping memory 60. Further, the decay rate is increased by changing count sources causing the sound level to reach a much quicker termination point. Still further, in some circumstances it may be desirable to shift the pitch of the resulting tone preferably in the positive or sharp direction. Such a shift if selected will be caused by the present invention.

The present invention may be embodied in other specific forms without departing from the spirit or essential attributes thereof and, accordingly, reference should be made to the claims, rather than to the foregoing specification as indicating the scope of the invention.

I claim:

1. In an electronic musical instrument having a greater number of selectively actuable keys or switches than tone generators of the type wherein tones corresponding to the respective notes of a musical scale are produced by reading from memory stored sample points of harmonic structures of waveforms and envelopes characteristic of the selected waveforms, and by interpolating between said harmonic structures of the waveforms during the transient periods of said waveforms, an apparatus for causing a snubbing of the tone produced in response to the depression of at least one key comprising:

means for selecting a percussive string-type waveform and for generating a signal indicative of such selection;

means for detecting the release of a depressed key and the presence of the signal indicative of the selection of a percussive string-type waveform and for generating a signal indicative of such detection;

means for halting further interpolation of the selected waveform and switching to a preselected harmonic structure of said selected waveform;

means for variably controlling the envelope amplitude, shape and rate of decay of the selected waveform;

said last two recited means being actuable in response to the signal indicative of the detection of the release of the depressed key and the signal indicative of the selection of a percussive string-type waveform for the duration of the transient period causing a snubbing of the produced tone.

2. An apparatus in accordance with claim 1 wherein said percussive string-type waveforms are of instruments which have their strings struck or plucked.

3. An apparatus in accordance with claim 1 wherein said apparatus for causing a snubbing of the tone produced in response to the depression of at least one key further comprises:

means for shifting the pitch of the generated tone of the selected waveform being actuable in response to the signal indicative of the detection of the release of the depressed key and the signal indicative of the selection of a percussive string-type waveform for the duration of the transient period.

4. An apparatus in accordance with claim 3 wherein said shifting of the frequency of the pitch on the occurrence of the signal indicative of said detection causes an upward shift in the frequency resulting in the produced tone sounding sharper to the listener.

5. An apparatus in accordance with claim 1 wherein said means for variably controlling the envelope amplitude, shape and rate of decay of the transient waveform on the occurrence of the signal indicative of said detection causes:

a variation in envelope amplitude in accordance with any instantaneous changes in amplitude between the envelope associated with the preselected harmonic structure and the envelope associated with the harmonic structure which was being interpolated;

a variation in envelope shape in accordance with any changes in said shape between the envelope associated with the preselected harmonic structure and the envelope associated with the harmonic structure which was being interpolated; and, an increase in the rate of decay of the transient waveform envelope.

6. In an electronic musical instrument having a greater number of selectively actuable keys or switches than tone generators of the type wherein tones corresponding to the respective notes of a musical scale are produced by reading from memory stored sample points of harmonic structures of waveforms and envelopes characteristic of the selected waveforms, and by interpolating between said harmonic structures of the waveforms during the transient periods of said waveforms, a method for causing a snubbing of the tone produced in response to the depression of at least one key comprising the steps of:

selecting a percussive string-type waveform and for generating a signal indicative of such selection;

detecting the release of a depressed key and the presence of the signal indicative of the selection of a percussive string-type waveform and for generating a signal indicative of such detection;

halting further interpolation of the selected waveform and switching to a preselected harmonic structure of said selected waveform;

variably controlling the envelope amplitude, shape and rate of decay of the selected waveform;

said last two recited steps occurring in response to the signal indicative of the detection of the release of the depressed key and the signal indicative of the selection of a percussive string-type waveform for the duration of the transient period for causing a snubbing of the produced tone.

7. A method in accordance with claim 6 wherein said percussive string-type waveforms are of instruments which have their strings struck or plucked.

8. A method in accordance with claim 6 wherein said method for causing a snubbing of the tone produced in response to the depression of at least one key further comprising the step of:

shifting the pitch of the generated tone of the selected waveform occuring in response to the signal indicative of the detection of the release of the depressed key and the signal indicative of the selection of a percussive string-type waveform for the duration of the transient period.

9. A method in accordance with claim 8 wherein said shifting of the frequency of the pitch on the occurrence of the signal indicative of said detection causes an upward shift in the frequency resulting in the produced tone sounding sharper to the listener.

10. A method in accordance with claim 6 wherein said steps for variably controlling the envelope amplitude, shape and rate of decay of the transient waveform on the occurrence of the signal indicative of said detection further comprises the steps of:

varying the envelope amplitude in accordance with any instantaneous changes in amplitude between the envelope associated with the preselected harmonic structure and the envelope associated with the harmonic structure which was being interpolated;

varying the envelope shape in accordance with any changes in said shape between the envelope associated with the preselected harmonic structure and the envelope associated with the harmonic structure which was being interpolated; and, increasing the rate of decay of the transient waveform.

* * * * *